US005375987A

United States Patent [19]

Brent

[11] Patent Number: 5,375,987

[45] Date of Patent: Dec. 27, 1994

[54] ROTARY VANE MECHANICAL POWER SYSTEM UTILIZING POSITIVE DISPLACEMENT

[76] Inventor: Charles R. Brent, 3901 Jamestown Rd., Hattiesburg, Miss. 39402

[21] Appl. No.: 61,199

[22] Filed: May 13, 1993

[51] Int. Cl.[5] ..... F01C 1/00; F03C 2/00

[52] U.S. Cl. ..... 418/227; 418/243

[58] Field of Search ..... 418/227, 243

[56] References Cited

U.S. PATENT DOCUMENTS

| | | | |
|---|---|---|---|
| 996,984 | 7/1911 | Grindrod . | |
| 1,136,976 | 4/1915 | Reaugh | 418/227 |
| 1,241,513 | 10/1917 | Hicks, Jr. . | |
| 1,394,861 | 10/1921 | Reaugh | 418/227 |
| 2,006,298 | 6/1935 | Hutchinson, Jr. | 103/124 |
| 2,084,846 | 6/1937 | Hutchinson, Jr. | 103/124 |
| 3,244,157 | 4/1966 | Tanferna et al. | 123/14 |
| 3,302,870 | 2/1967 | Schell | 230/149 |
| 3,636,930 | 1/1972 | Okada | 418/227 |
| 4,055,156 | 10/1977 | Salguero | 123/8.33 |
| 4,086,881 | 5/1978 | Rutten | 418/243 |
| 4,373,484 | 2/1983 | Boehling | 123/241 |

FOREIGN PATENT DOCUMENTS

| | | | |
|---|---|---|---|
| 0883563 | 7/1949 | Germany | 418/227 |

*Primary Examiner*—Richard A. Bertsch
*Assistant Examiner*—Charles G. Freay

[57] ABSTRACT

A basic rotary vane mechanical power system, suitable for engines, pumps, compressors and the like, having an enclosed chamber housing a rotating hub plate, with the hub plate assembly supporting a plurality of spaced apart rotary vanes rotating on their own separate shafts and carried in a circular path by the hub plate assembly. The rotation of the hub plate assembly imparts rotation of the plurality of vanes within the enclosed, tight-fitting chamber, the angular rotation of the vanes being one-half of the angular velocity at which the hub plate and power shaft are rotating and transmitting power, or some other suitable ratio. During rotation of the vanes, the volume between the vanes increases and decreases, so that the volume of fluid within that space is contracted or expanded to drive the system or provide a source of power to the system or the working fluid. The volume of fluid between the vanes is determined principally by the thickness of the vane on one side of this circular path and also determined by the width of the vane where the chamber reaches its maximum width.

31 Claims, 7 Drawing Sheets

ROTARY VANE MECHANICAL POWER SYSTEM UTILIZING POSITIVE DISPLACEMENT

BACKGROUND OF THE INVENTION

1. Field of the Invention

The system of the present invention relates to orbital rotary piston power systems, and to rotary vane mechanisms. More particularly the present invention relates to a power system for internal combustion engines, steam engines, fluid power units, fluid motors, pumps, compressors, turbochargers and the like, utilizing orbiting rotary vanes or rotary pistons confined within a close-fitting enclosure to provide expanding and contracting chambers that transmit power when coupled to input or output drive shafts.

2. General Background

In the general field of powered pumps or engines, rotary piston pumps and rotary piston engines have been designed in many variations. Rotary piston pumps are exemplified by the following U.S. patents: U.S. Pat. No. 4,373,484 issued to Boehling in 1983; U.S. Pat. Nos. 2,006,298 and 2,084,846 both issued to Hutchinson in 1935 and 1937 respectively; and earlier patents, U.S. Pat. No. 1,241,513 issued to Hicks in 1917, and U.S. Pat. No. 996,984 issued to Ginrod in 1911. In each of these designs elliptical or elongated pistons rotate on shafts whose positions are fixed within a confined space. The systems include rocker valves or ports positioned to admit fluids into an expanding chamber at its minimum volume or into a contracting chamber at or near its maximum volume, depending on whether expansion, pumping or compression was the desired power transmission effect. Other such systems will also be referred to in the list of art that is included in applicant's art statement accompanying this application.

For example, the '484 patent to Boehling teaches an improved rotary piston mechanism including stationary components, and rotor components housed within the stator components. The axles of the rotary components rotate within fixed positions in holes (or bearings) in the two stationary (stator) flat walls.

Another prior art engine is the famous "Wankel" engine, which is a rotary engine, having a somewhat triangular, thickened piston travelling back and forth between two somewhat cylindrical chambers undergoing intake, compression, power and exhaust strokes, said piston coupled by an internal gear to a drive shaft.

Neither of these examples, nor any of the other prior art patents, teach the concept of the present invention. The present invention, as will be described further, may share the same classification, rotary engine, but the present invention teaches a completely different concept of rotary mechanical power systems.

Other objects of the invention will become obvious to those skilled in the art from the following description of the invention.

SUMMARY OF THE PRESENT INVENTION

The present invention introduces a fluid mechanical power system for extracting energy from a working fluid such as steam, heated air and other gaseous or liquid fluids under pressure which produces work by expanding or pushing with force against moving parts within mechanically enclosed volumes, or, in an opposite mode of operation, imparting energy to a fluid when power is applied to a central shaft. What is provided is an enclosed chamber housing a rotating hub plate, with the hub plate assembly supporting a plurality of spaced apart rotary vanes rotating on their own separate shafts and carried in a circular path by the hub plate assembly. The rotation of the hub plate assembly imparts rotation to the plurality of vanes within the enclosed, tight-fitting chamber, the angular rotation of the vanes being some multiple or fractional multiple of, as depicted here one-half, the angular velocity at which the hub plate and power shaft are rotating and transmitting power. During rotation of the vanes, the volume between the vanes increases and decreases, so that the volume of fluid within that space is contracted or expanded to drive the system or provide a source of power to the system or the working fluid. The volume of fluid between the vanes is determined principally by the thickness of the vane when the vane is perpendicular to the end of its radius of travel on one side of this circular path and also determined by the width of the vane when it is aligned along the radius of travel, depicted here on the opposite side of the circular path. The inherent volume ratio of the maximum volume between vanes to the minimum volume between vanes ranges from about two to one (2:1) for three vanes with mechanically sound dimensions (2.7:1 as depicted herein) to about eight to one (8:1) for multiple vane units with more than four vanes. This inherent volume expansion ratio can by multiplied by a factor of two(2) to ten(10) by appropriate limiting elements, such as slide valves, injector arrangements or superchargers, allowing the unit to function as a basic power unit for a Rankine cycle steam engine, an Otto cycle internal combustion engine, a Brayton cycle (hot) gas engine, a Sterling engine, or a Diesel engine burning fuel oils. Properly ported, fitted and powered as a pump, the volume expansion draws fluids into the chambers and the vanes impart motion to the fluid exiting the system by positive displacement of the fluids within the chambers.

Therefore, it is a principal object of the present invention to provide a fluid mechanical power system which extracts energy from a working fluid to produce work by expanding the fluid with force within a confined chamber against moving parts within the chamber, then exhausting the spent fluid;

It is a further principal object of the present invention to provide a fluid mechanical power system which allows the unit to function as a basic power unit for a Rankine cycle steam engine, an Otto cycle internal combustion engine, a Brayton cycle gas engine, a Sterling engine, or a Diesel engine burning fuel oils;

It is a further object of the present invention to provide a fluid mechanical power system which can act as a turbine in the generation of hydropower or as a hydraulic pump, power unit, turbocharger, compressor, transmission, vacuum pump or flow meter;

It is a further object of the present invention to provide a fluid mechanical power system which provides an essentially vibrationless rotary heat engine with major advantages in small size and low weight per horsepower output or per kilowatt, for more efficient propulsion of vehicles of different types including automobiles, trains, aircraft and boats among others;

It is the further object of the present invention to provide a fluid power system utilizing rotating vanes orbiting on an impeller-back plate with the vanes rotating at some multiple or fractional speed of the back plate, which, by combining these two harmonic motions, the rotating vanes contract and expand the volumes between them within a confining chamber to provide power for driving systems.

BRIEF DESCRIPTION OF THE DRAWINGS

To fully understand the nature and objects of the invention refer to the following detailed description in connection with the accompanying drawings forming a part of this specification and in which similar numerals of reference indicate corresponding parts in all the figures of the drawings.

DETAILED DESCRIPTION OF THE PREFERRED EMBODIMENT

Figure 1:
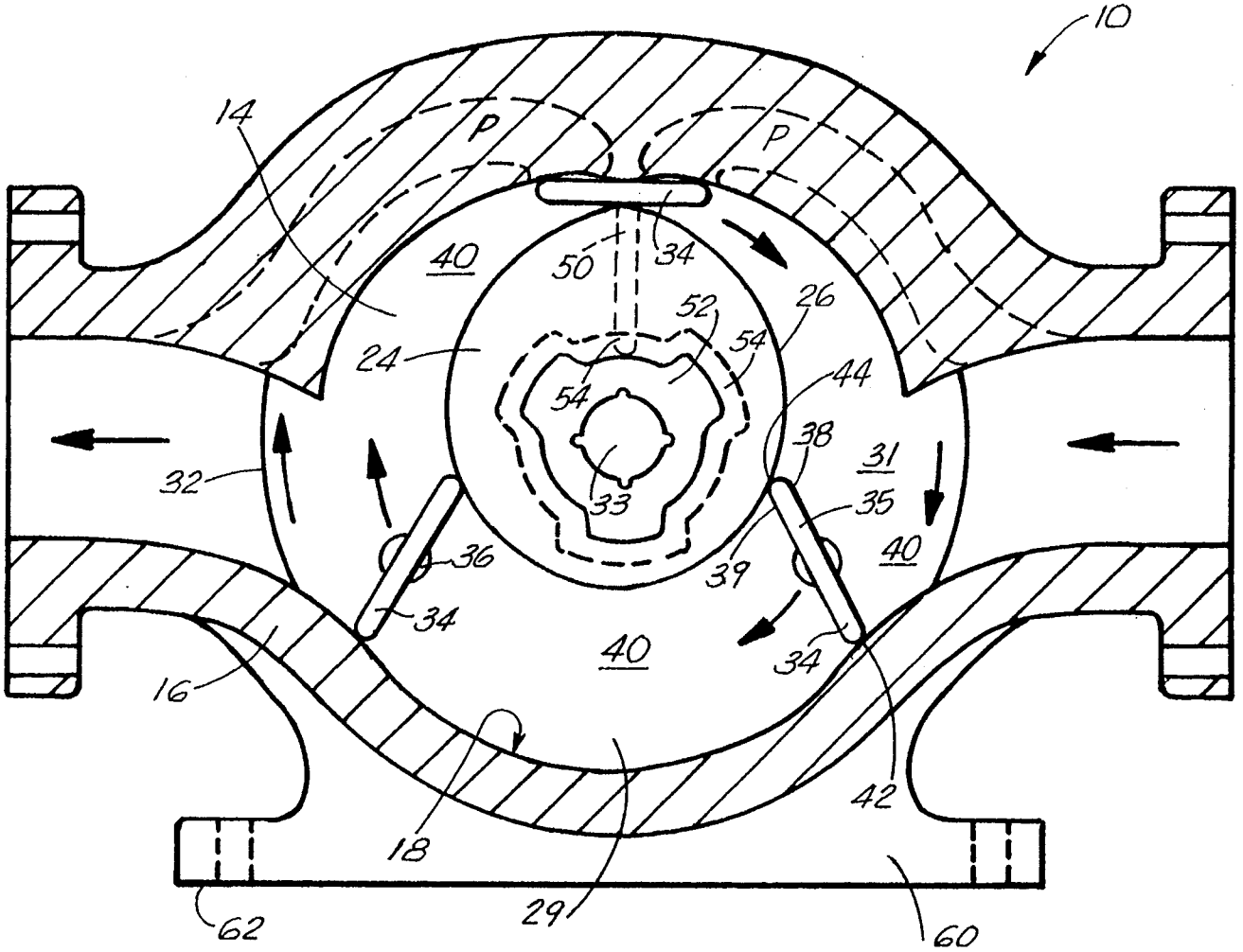
FIG. 1 is a vertical cross-sectional view of an embodiment of the mechanism of this invention as a pump taken in a plane perpendicular to the power shaft and showing a configuration of the orbiting, rotating members, one of which is in its top-dead-center position within a chamber of close-fitting confining walls.
Figure 2A:
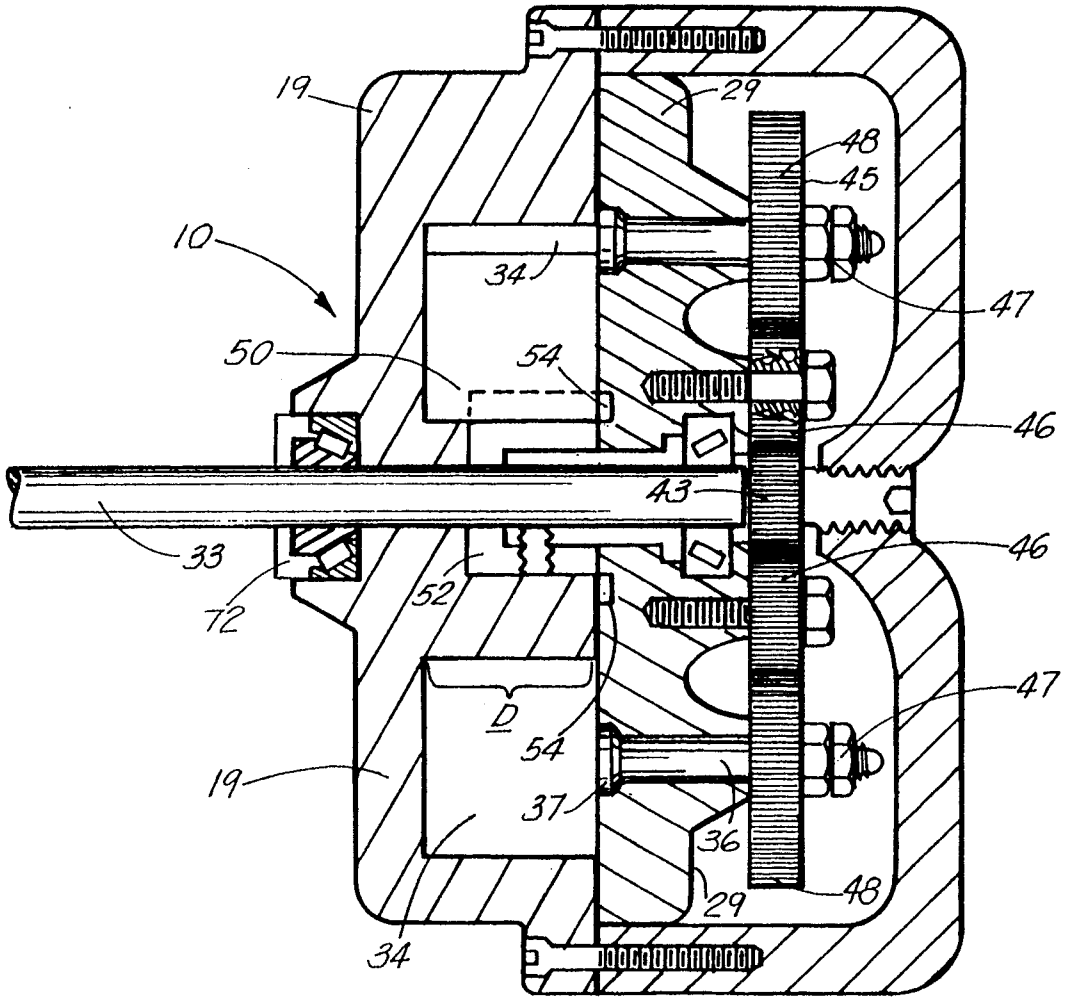
FIG. 2A is a vertical sectional view of the apparatus of the present invention along the axis of the power shaft with the basic power system utilized as a pump.
Figure 2B:
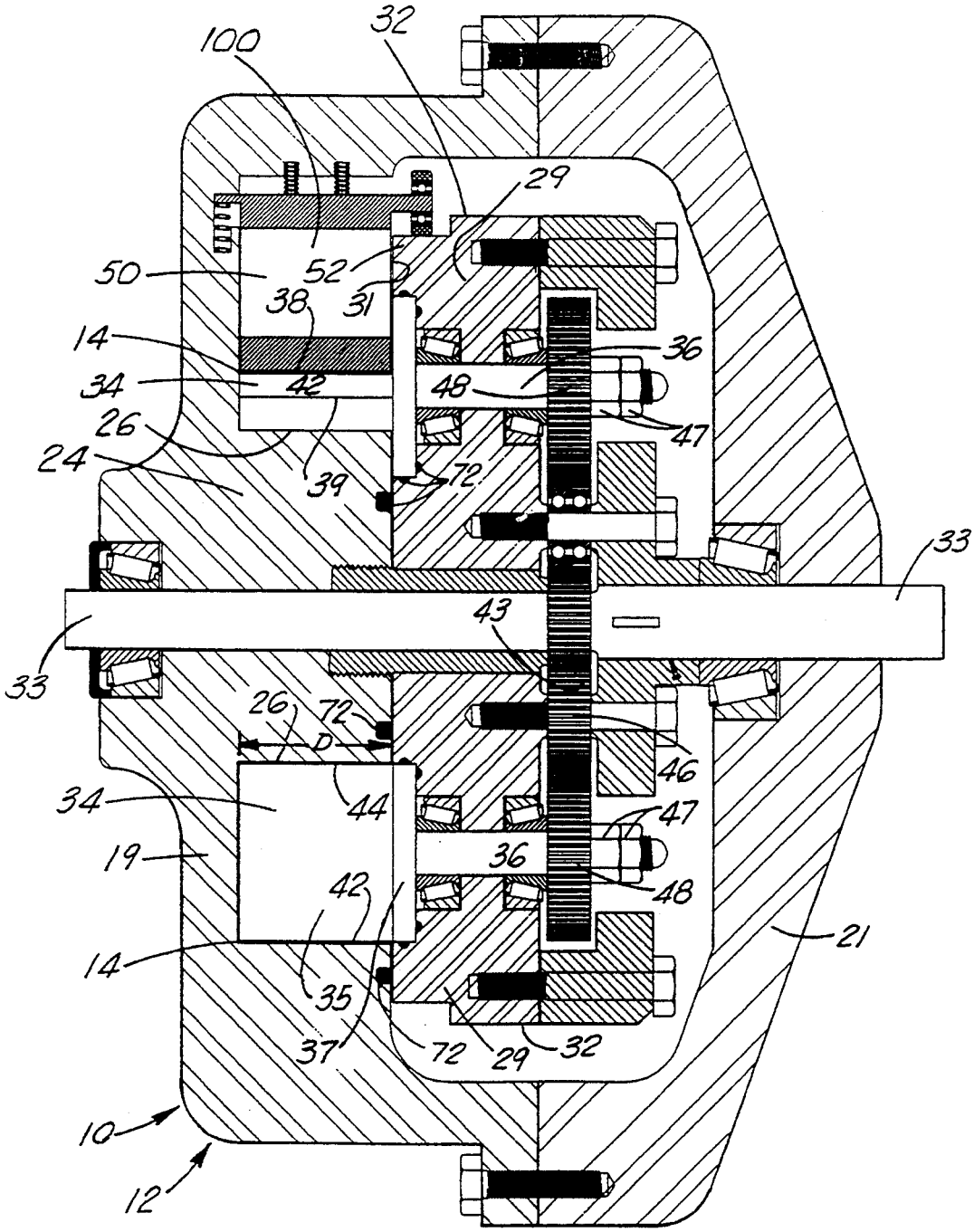
FIG. 2B is a vertical sectional view of the apparatus of the present invention along the axis of the power shaft with the basic power system utilized as a steam engine.
Figure 3:
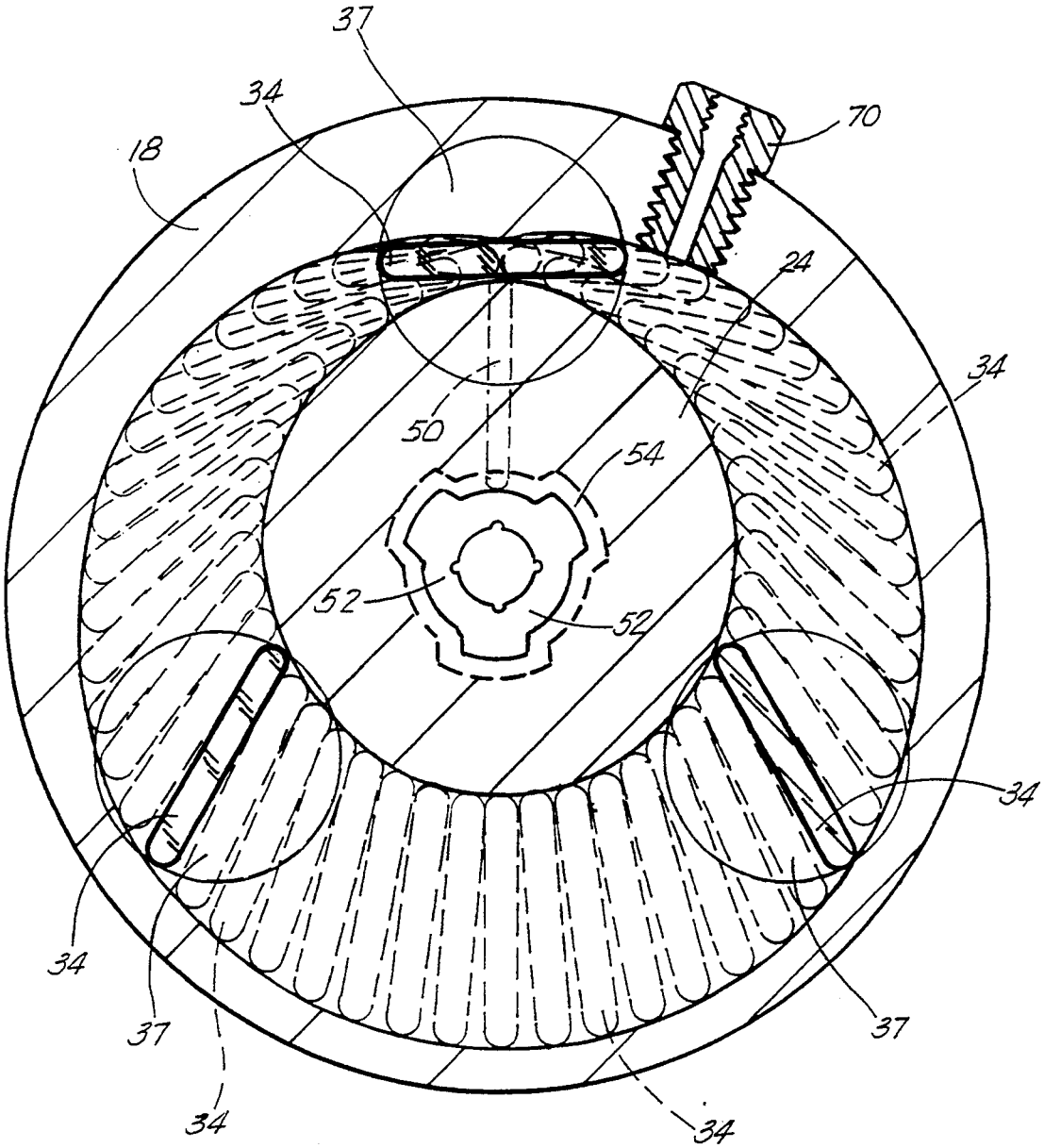
FIG. 3 is cross-sectional view illustrating schematically the interrelationship of stator, backplate and rotating members at different rotational positions within one complete rotation of the backplate and power shaft of the apparatus of the present invention.

FIGS. 1 through 5B would illustrate the preferred embodiment of the apparatus of the present invention by the numeral 10. FIGS. 1 through 4F more particularly illustrate the apparatus of the present invention utilized as a pump in FIGS. 1 and 2A or as a steam engine in FIGS. 2B and 4A through 4F. Referring initially to FIGS. 1 through 3, there is illustrated a principal cavity 14, which could be referred to as a stator cavity 14, with cavity 14 formed by a principal housing 16, with housing 16 formed by a continuous side wall 18, wherein there is defined the internal cavity 14 formed by the continuous side wall 18, the front portion 19 and the back 21. As illustrated in the Figures, side wall 18 is non-circular in configuration, but would have a uniform depth (D) as seen in FIGS. 2A and 2B, which would be in perpendicular conjunction with front wall 19 and back plate 31. There is further included within cavity 14 a central member 24, which could be defined as a fixed stator 24, having a teardrop shape, with somewhat cylindrical, but not circular cylindrical walls 26, extending perpendicular from front wall 19 and further shaping the cavity 14. There is further provided, as seen in the Figures, a plurality of internal moving members, or vanes 34, which together with other essential components, constitute the mechanical power assembly constituting the present invention.

As illustrated further, said cavity 14 is closed on the back by a rotating backplate 29 which is flat on its internal face 31 and circular on the edge 32. The rotating backplate 29 is affixed to a drive shaft 33 which provides an output or input source of power. Further, as illustrated in FIGS. 1, 2, and 3, there is provided a plurality of one or more identical rotating members or vanes 34, having a body portion 35, defining semi-cylindrical ends 42 and 44 and the two flat sides 38 and 39 therebetween, which are driven during operation. Each of the vanes 34 is affixed to its own individual shaft 36 extending through the backplate 29, and, in high pressure applications, rotates on a circular plate 37. The vanes are equally spaced apart in such a manner to divide the cavity 14 into a plurality of specific volume chambers 40 which vary in volume as the backplate 29 rotates and the vanes 34 move through the cavity 14, sealing off the chambers 40 formed between the wall 18 of the housing 16 and the central stator 24. Precise means of positioning the rotating members or vanes 34 and imparting their rotation on the individual shafts 36 is done in such a manner that each vane 34 rotates at some exact multiple or fraction of the speed of the drive shaft 33 and backplate assembly 29, exactly one-half of the speed of the drive shaft as shown in FIGS. 1 through 5B. The means for accomplishing this is through an arrangement of timing gears, chains or belts mounted behind the backplate 29 of the cavity 14, for imparting rotation to the shafts during operation of the assembly. FIG. 6 illustrates a basic power unit with a one to one ratio of vane rotation to shaft rotation.

As seen in the Figures, there is provided first a central stationary gear 43 wherein passes the central shaft 33 without engagement, the central gear 43 is geared into reversing gears 46, which in turn impart rotation to the vane shafts 36 in gears 48. The central gear 43, reverse gears 46 and the vane shaft gears 48 provide the 2:1 rotation ratio (as depicted here) between the central power shaft 33 and the vane shafts 36. The rotating members or vanes 34 on the opposite side of the backplate 29 and all rotating members on shaft 36 opposite to the rotating members 34 may be held in place by two locking nuts 47, adjustable for timing purposes, or by other means.

As explained earlier, critical to the operation of the system, is the multiple or fractional gear ratio relationship between the vane gears 48 and the central gear 43. As shown in FIGS. 1 through 5B, the said combination of gears imparts rotation to the vane members 34 at one half the rate of rotation of the backplate 29 and its shaft 33, with the reversing gears 46 rotating the vane gears 48 in the direction opposite the direction of rotation of the central shaft 33.

Reference is now made to FIGS. 3 and 4, the drawings which illustrate the theory of operation of the system during the cycles of rotation of the members previously referred to. During operation, the backplate 29 which is flat and circular is rotating and sealing the cavity 14 and providing a circular orbit for the rotating vanes. However, due to the somewhat elliptiod shape of cavity 14 and the nodes formed by the shape of stator 24, the vanes 34 positioned at a fixed distance from the center of the drive shaft 33, continually span the cavity 14 and close off or divide each chamber 40 of cavity 14 formed between each pair of vanes 34, from the other chambers, continuously varying the width and volume of each chamber 40 by their own rotation, allowing expanding or pressurized substances to expand or push against the rotating members, thus impelling the backplate 29, shaft 33 and rotor 34 assembly to turn and deliver power at the output shaft 33.

Further, there is provided an additional chamber limiting means as seen in the drawings. This means includes a slide or slide valve 50 positioned within the stator at or near the narrowest point in cavity 14. During operation, slide valve 50 is lifted into a position intervening across cavity 14 by a cam 52 affixed to drive shaft 33, as the drive shaft 33 turns the back plate 29 into a position where a rotating member 34 has just cleared the end of slide valve 50. An extension at the bottom of the slide valve 50 fits into a retracting groove 54 in backplate 29, thus retracting the slide valve 58 as the next rotating member 34 approaches. The slide valve 50 limits the initial size of the cavity 40 which is initiating a power stroke, increasing the volume expansion ratio up to a nominal value of 22:1 (as shown here). The chamber limiting slide valve 50 could equally as well be positioned to intervene from through the outer wall 18 of cavity 14, lowered by one or more springs and a cam built into the edge 32 of backplate 29 as illustrated in FIG. 2B. A mounting base 60, utilized as a pump or motor mount, is affixed or molded to the case 62 where appropriate to hold the motor or pump in a fixed position as desired.

During the operation of the present invention as a steam engine, (FIGS. 2B, 3, 4A–4F), while the backplate 29, shaft 33 and rotary vane 34 assembly turn, and after one of the vanes 34 has moved about one twelfth (1/12) of a revolution from its top-dead-center position, the chamber limiting device 50 moves into place creating a small chamber A′, thus a small volume between it and the receding vane. At this time a steam injector 70 injects a measured charge of pressurized steam 100 into that small volume. (In the steam engine depicted in FIGS. 2B, 3, and 4 of this patent the expansion ratio, the ratio of the maximum chamber volume, chamber C in FIG. 4A to the small volume of chamber A′ in FIG. 4C, is about 22:1.)

THE OPERATION OF THE POWER DRIVE SYSTEM

Figure 4A:
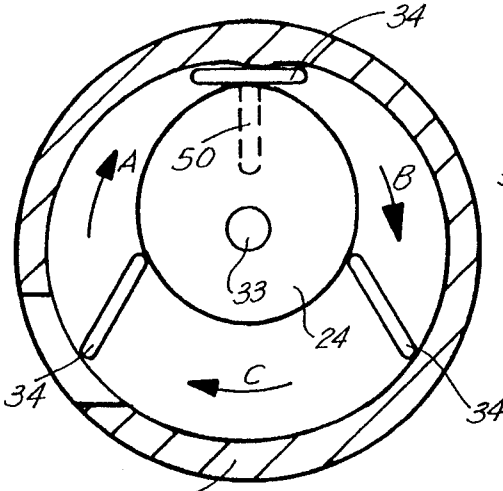
FIGS. 4A through 4F illustrate schematic views of the apparatus of the present invention during one third of a rotation cycle of the preferred embodiment of the present invention.
Figure 4B:
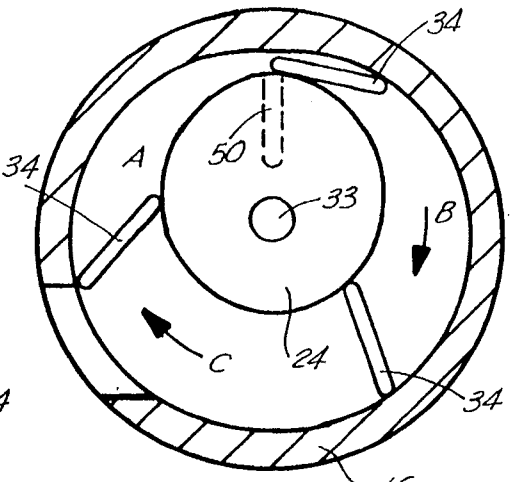
Figure 4C:
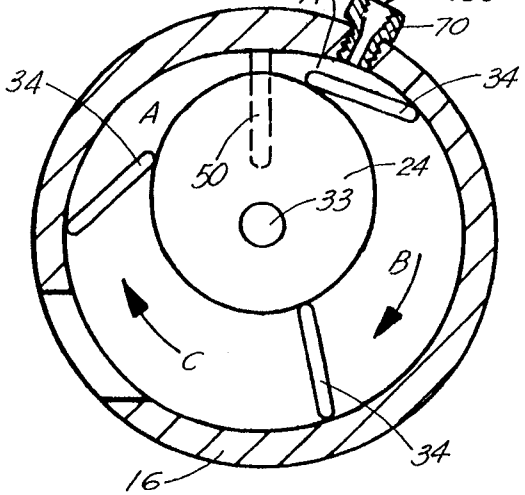
Figure 4D:
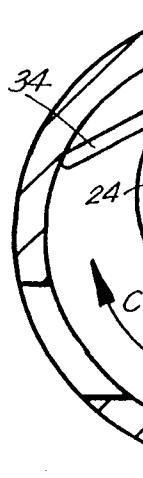
Figure 4E:
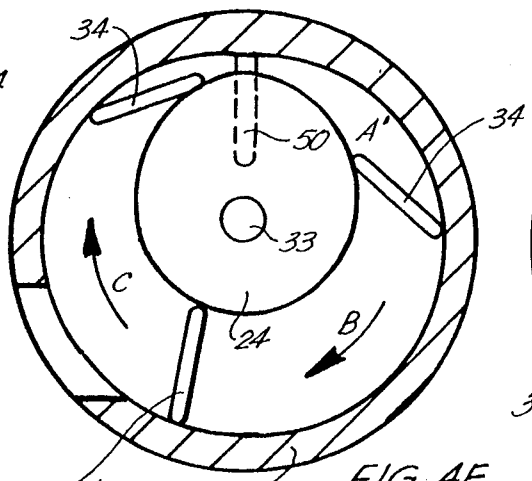

Reference is made to FIGS. 3 and 4A through 4F which depict a complete drive cycle in FIG. 3 and an injection-partial expansion power cycle in FIGS. 4A–4F in the system of the present invention. Referring to FIGS. 4A through 4F initially, as illustrated in FIG. 4A, there is illustrated the steam engine format 12 with the cavity 14 formed within, between the housing wall 16, the wall of the stator 24, the front wall 19 and the rotating backplate 29. There are further illustrated three vanes 34 positioned on the rotating backplate 29 within the system. It should be noted, as stated earlier, vanes 34 as shown here are rotating at one-half the speed of the backplate 29 in the cavity 14. Further each pair of vanes would define a separate chamber 40, which chambers are depicted as chambers A, B, and C, along with chamber A′ formed by the intervention of slide valve 50. Therefore, as illustrated, a volume of steam 100 being injected into the chamber A′ would expand with force against the receding vane 34, moving it and making chambers A′ and B slightly larger, and therefore it, along with the vane enclosing chamber B, which received its charge of steam just 120° prior to chamber A′, impart rotation to the backplate 29, as seen in FIG. 4C. FIG. 4D illustrates further expansion of the steam in chambers A′ and B with additional steam being injected into A′ if needed for maximum torque demands. FIG. 4E represents movement and expansion of chambers A′ and B again, chamber B shown almost to full expansion in FIG. 4F. Now the steam in chamber A′, which has now become chamber A, expands through the same path and volume change as was just illustrated for chamber B until it reaches full expansion, thus ending one power expansion stroke for chamber A.

Figure 4F:
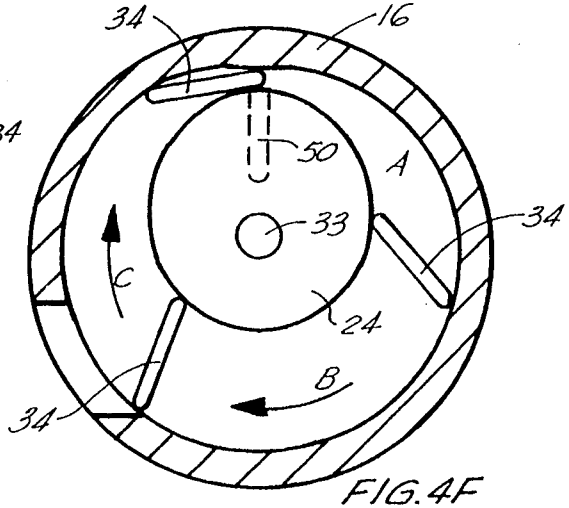
Figure 5A:
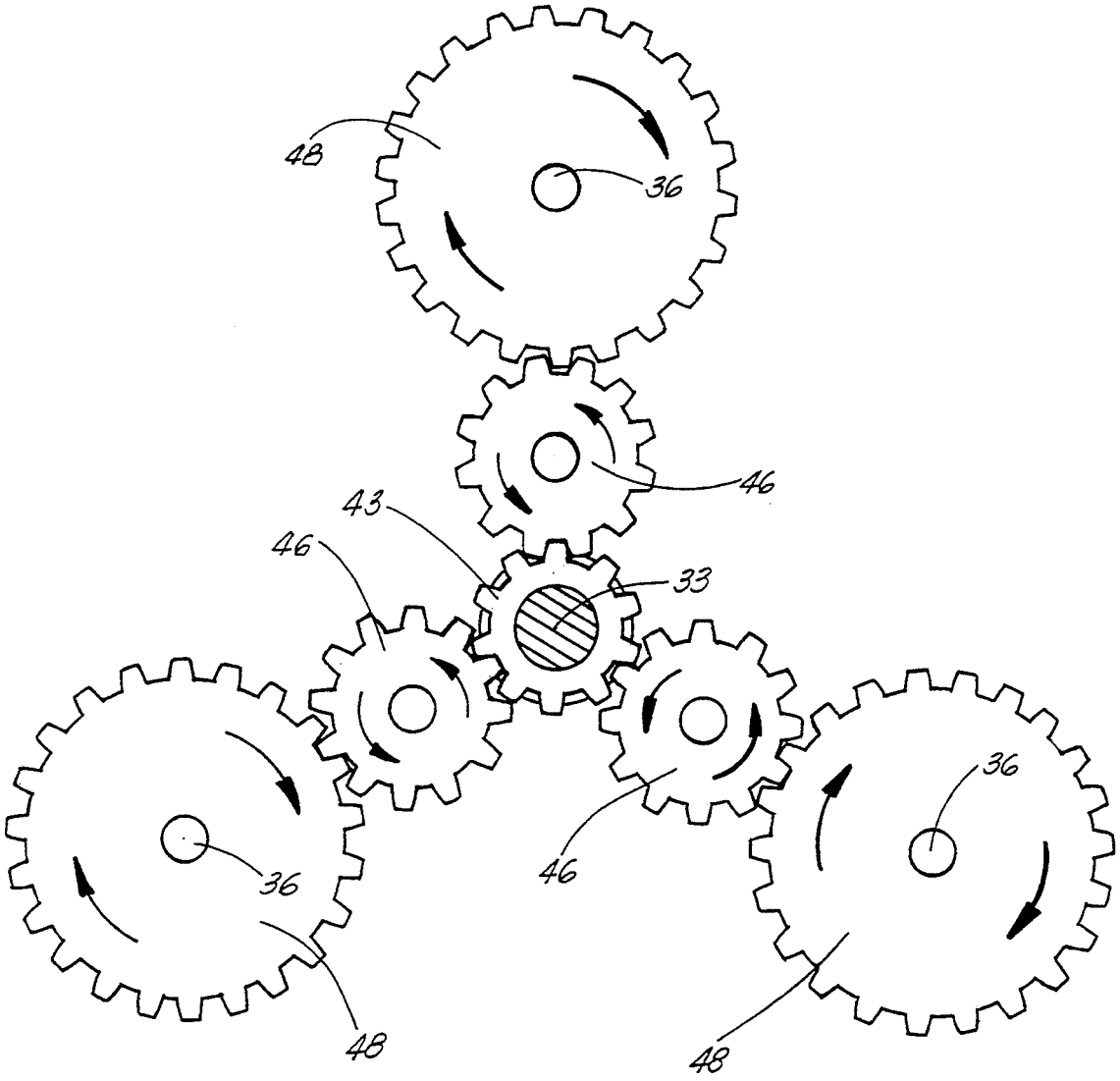
FIGS. 5A and 5B illustrate partial views of the gearing mechanism interconnecting the power shaft with the rotating vanes in the preferred embodiment of the apparatus of the present invention.
Figure 5B:
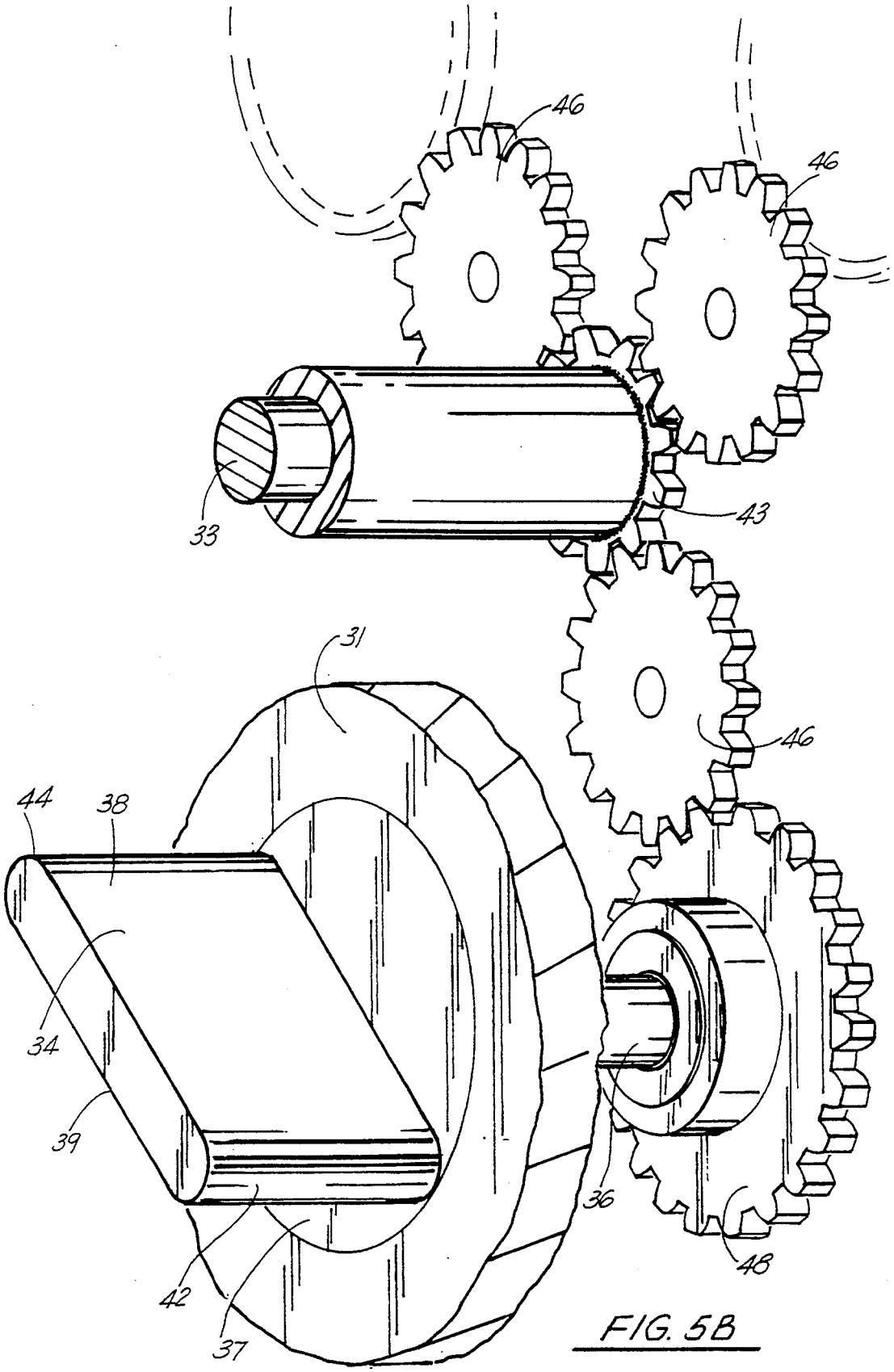

As was previously noted, the vane 34, which was in the position as noted in FIG. 4A has since rotated from the top-dead-center position in FIG. 4A to the position shown in FIG. 4F, where a second vane 34 is moving into top-dead-center position from the position illustrated in FIG. 4A. It is this sequence of events from FIG. 4A through FIG. 4F which will represent one repeating injection cycle sequence in the power cycle as the vanes are rotated throughout the chamber. One complete power stroke for one chamber is represented by the movement of a single chamber through the expansion which both chambers A′ and B have experienced as illustrated in FIGS. 4A through 4F, thus two power strokes and an exhaust stroke are occurring simultaneously in the three vane steam engine depicted in FIGS. 4A through 4F.

In FIG. 3 there is depicted a sequential view of three identical vanes 34 being rotated within the cavity 14 and the circular base under each of the vanes 34 representing the plate 37 upon which each of the vanes rotate as they are rotated by vane gears 48, as described earlier. This sequential depiction shown in phantom view in FIG. 3 of each of the vanes 34 illustrates clearly the type of rotation that a vane undergoes as a complete revolution is completed, i.e., each vane depicted here would undergo a one-half rotation as it rotates through one complete revolution of the backplate 29 and shaft 33. FIG. 6 is a similar view illustrating a power unit in which the vanes undergo one complete reverse rotation as the backplate-hub shaft assembly undergoes one complete rotation.

The charge of steam 100 expands with force against the receding vane, transmitting a smooth torque on the shaft through the connection of the vane shaft, backplate and hub assembly. Under normal operation the torque does not vary by a factor of more than two or three during 210 to 240 degrees of traverse of the vane during a power stroke, which places it at or near the exhaust port. While the aforementioned vane travels through its power stroke, a second vane trailing it by 120 degrees of revolution has likewise received its charge of steam and traversed almost half of the path of its power stroke.

Under heavy loads or starting conditions, the steam injector or a second steam injector could direct the full pressure of the steam from the boiler for the first 60 degrees of rotation or for the full traverse of the vane in its power stroke, providing much greater torque; providing of course that the motor components were designed to handle such a heavy load. These maximum power conditions could only be achieved with considerable sacrifice of efficiency, because the engine would exhaust the steam out of the engine at $\frac{1}{3}$ to $\frac{1}{2}$ its maximum steam pressure, not a very efficient use of steam.

Obviously, different porting arrangements, chamber limiting devices, steam slide valves, injectors and the like can be configured for essentially equivalent performance.

Applying power to the shaft 33 and running the motor in the reverse or opposite sense, with an appropriately shaped cam, changes the motor or power system into a high volume pump or compressor providing low pressures without chamber limiting slide 50, or higher pressures with it incorporated in the power system and lifted with the new cam as illustrated in FIG. 1. For use with incompressible fluids and in high pressure pumping and compression applications, passages P, as illustrated in FIG. 1, are required to transmit fluid smoothly through the pumping system.

The equations provided within this patent accept changes in thickness, radius of travel and length of the rotating members, readily generating the rotating members 34 and cavity shape 14 when incorporated into a computer graphics program. To a person familiar with the art an obvious modification generates the design of a pump or power system without the reversing gear(s) whose rotating members turn in the same direction as the shaft at one and one-half the shaft speed (or some other multiple). Such a pump or power system normally has less of a positive displacement character, but can be useful in some applications and modifications.

Coordinates of the centers of curvature of the circular cylindrical vane tips 42 and 44 are given by the following equations in computer syntax:

$$X_O = X_C + R^*\mathrm{Sin}(w) + (L/2)^*\mathrm{Cos}(w/2)$$
$$Y_O = Y_C - R^*\mathrm{Cos}(w) + (L/2)^*\mathrm{Sin}(W/2)$$
$$X_I = X_C + R^*\mathrm{Sin}(w) - (L/2)^*\mathrm{Cos}(w/2)$$
$$Y_I = Y_C - R^*\mathrm{Cos}(w) - (L/2)^*\mathrm{Sin}(W/2)$$

where:

$X_o$=the X coordinate of the center of curvature of the outside tip of a vane 42, $Y_o$=the Y coordinate of the center of curvature of the outside tip of a vane 42, $X_I$=the X coordinate of the center of curvature of the inside tip of a vane 44, $Y_I$=the Y coordinate of the center of curvature of the inside tip of a vane 44, $X_c$=the X coordinate of the center of the drawing (or screen) or the center of the power drive shaft, $Y_c$=the Y coordinate of the center of the drawing, R=the radius of travel of the centers of the vanes, w=the angle of travel of a vane from its top dead center position as it traverses the cavity, measured in radian.

L=the length of the flat sides 38 and 39 of a vane from a frontal view without the added dimensions of its circular tips, and RT=the radius of curvature of the semi-circular cylindrical vane tips.

The two flat sides 38, 39 of each vane can be obtained by drawing lines between the following sets of points:

$$[XO1 = X_O + RT^*\mathrm{Sin}(w/2),\ YO1 = Y_O - RT^*\mathrm{Cos}(w/2)]$$
and
$$[XI1 = X_I + RT^*\mathrm{Sin}(w/2),\ YI1 = Y_I - RT^*\mathrm{Cos}(w/2)]$$

provide end points for one side of the vane 38; and $$[XO2 = X_O - RT^*\mathrm{Sin}(w/2),\ YO2 = Y_O + RT^*\mathrm{Cos}(w/2)]$$
and
$$[XI2 = X_I - RT^*\mathrm{Sin}(w/2),\ YI2 = Y_I + RT^*\mathrm{Cos}(w/2)]$$

provide end points for the other side of the vane 39.

Points on the outer confirming wall 18 tangent to the moving vane tips can be calculated from the following equations:

$$XOW = X_o = RT^*\ \mathrm{Sin}\ (w)$$

$$YOW = Y_o - RT^*\ \mathrm{Cos}\ (w)$$

while points on the inner confining wall 26 tangent to the vane tips can be calculated from the following equations:

$$XIW = X_I - RT^*\ \mathrm{Sin}\ (w)$$

$$YIW = Y_I + RT^*\ \mathrm{Cos}\ (w)$$

where:

XOW,YOW=the X,Y coordinates of points on the outer confining wall 18,

XIW,YIW=the X,Y coordinates of points on the inner confining wall 26 and

All other symbols remain the same as mentioned above.

From these equations the shape of the confining cavity for the vane shape illustrated can be determined. Also the offset path of a milling tool whose center is travelling one tip radius from each wall can be determined by calculating enough points XO,YO and XI,YI to provide the required milling precision. Obviously other vane shapes can be employed in the rotary vane power system design.

There are myriads of applications of the invention of this patent in one of its forms in the pump, power unit, heat engine, compressor or other obvious configurations. A dual power unit with chambers on each side of the back plate and the vane positioning gears has a better distribution of transverse forces on the rotating members' shafts, and dual or cascading power units seem useful in internal combustion and Sterling engine applications. Other obvious configurations of this invention could be tailored for specific applications such as turbochargers, flow meters, artificial heart and the like. Different numbers of vanes could be used ranging from one to eight or ten, perhaps twenty. Three or four vanes seem optimum because of space limitations on the number of planetary gears. The vanes could take on an almost infinite variety of shapes, different shapes having advantages in certain specific applications. For example, a pump or compressor which only has to increase the pressure by a factor of two could use elliptical vanes whose width is twice their thickness in a very simple basic pump. One can imagine almost infinite variations of the invention of this patent.

Glossary of Terms apparatus 10
steam engine 12
principal cavity 14
principal housing 16
continuous side wall 18
front wall 19
back 21
depth D
central stator member 24
central stator wall 26
backplate 29
internal face 31
side edge 32
central drive shaft 33
vanes 34
body portion 35
vane shafts 36
circular plate 37
flat sides 38, 39
ends 42, 44
chambers 40 chambers A, A', B, C
stationary gear 43
reversing gear 46
vane gears 48
backside 45
locking nuts 47
slide or slide valve 50
cam 52
retracting groove 54
mounting base 60
motor case 62
steam injector 70
seals 72
charge of steam 100
passages P Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A rotary mechanical power system, comprising:

a) a housing having a housing wall and a principal substantially closed cavity;

b) a rotating hub plate positioned within the closed cavity;

c) the housing including a stationary generally ellipse-shaped stator member having a stator wall and positioned within the closed cavity for defining a travel space between the housing wall and the wall of the stationary stator member, a narrow portion of the travel space being defined by a generally tapered end portion of the ellipse shaped stator member and the housing wall;

d) a plurality of at least three rotating members, each rotatably supported upon the rotating hub plate, and at circumferentially spaced apart positions so that the vanes do not contact one another for dividing the cavity into chamber spaces between the circumferentially spaced rotating members, the chamber spaces fluctuating in volume as the rotating members are rotated around the cavity upon the rotating hub plate;

e) inlet means for delivering a fluid, into each chamber space at a certain point during rotation of the hub plate, for driving the rotation of the hub member during a power cycle, at least two of said vanes forming a closed chamber with the stator and housing wall at all times during rotation and during a majority of the rotation of said hub plate;

f) exhaust port means for exhausting the fluid from each chamber space, as the chamber space reaches its maximum volume during rotation through the power cycle;

g) wherein the housing wall and ellipse-shaped stator define a pair of gradually decreasing area passageways including a first passageway between the inlet and the narrow portion and a second passageway between the narrow portion and the outlet, wherein each of the passageways are larger at the inlet and outlet, and gradually decreasing in area approaching said narrow portion.

2. The system in claim 1, further comprising sealing means for closing off the moving chambers on all surfaces where members move adjacent to one another or in contact with stationary members or between members moving at different surface velocities.

3. The system in claim 1 further comprising a means for restricting the volume of the chamber space by spanning and closing off a travel space at or near its narrowest width.

4. The system in claim 1, wherein the power system defines a means to extract energy from the injected fluid, such as steam, heated air, combustion gases or the like, or any fluid injected under pressure into the chambers.

5. The system in claim 1, wherein the rotating hub plate is affixed to a central shaft rotated by the hub plate and rotary member assembly, said hub plate positioned around or near to a stationary gear.

6. The system in claim 1, wherein each of the rotating members are likewise rotated by individual gears linked into a stationary gear through a reversing gear, so that reverse rotation is imparted to the gears during a power cycle.

7. The system in claim 1, wherein the rotating members further comprise substantially perpendicularly positioned vane members with respect to a back plate, each member spanning and dividing the cavity between the outer wall of the chamber and the stationary member.

8. The system in claim 1, wherein the rotating members rotated at a velocity of one-half of the rotation velocity of the hub plate.

9. The system in claim 1, wherein during a power cycle, the volumes of the spaces between the vanes increase and decrease, so that the volume of fluid injected or drawn into the chamber space between vanes is contracted or expanded.

10. The system in claim 1, wherein the volume ratio of the maximum volume between rotating members to the minimum volume ranges from about 2 to 1 for three rotating members, or up to 8 to 1 for rotating members in excess of four.

11. The system in claim 1, wherein the system operates as an engine or pump means.

12. A mechanical power system, comprising:

a) a principal substantially closed cavity;

b) a rotating hub plate for further defining and closing the closed cavity;

c) an generally ellipse-shaped stationary member positioned within the cavity space for further defining a travel space between a cavity wall and the stationary member;

d) a plurality of circumferentially spaced vanes rotatably positioned on the rotating hub plate at circumferentially spaced positions so that the vanes do not contact one another, the spacing and vanes defining a chamber space between the vane means, the chamber space fluctuating in volume as the vanes are rotated through the travel space;

e) inlet means for delivering a fluid into at least one chamber space at a certain point during rotation, for driving the rotation of the hub plate or extracting power from the hub plate;

f) means for restricting the volume of one of the chamber spaces by spanning and closing off the travel space at or near its narrowest width;

g) exhaust means for exhausting the fluid from at least one chamber space, as the hub plate is rotated through a power cycle; and h) a pair of passages that extend respectively between the inlet and the narrowest portion, and between the outlet and the narrowest portion.

13. The system in claim 12, wherein the power system defines a means to extract energy from the injected fluid, such as steam or the like, to operate as an engine, or is utilized to impart energy to a fluid to operate as a pump means.

14. The system in claim 12, wherein the rotating hub plate is affixed to a central shaft and is rotated around a central stationary gear.

15. The system in claim 12, wherein each of the vane means are likewise rotated by individual gears linked into the central stationary gear through a reversing gear, so that reverse rotation is imparted to each of the vane gears during a power cycle.

16. The system in claim 12, wherein the vane means further comprise substantially perpendicularly positioned vane members extending from the back plate, each member spanning and dividing the closed cavity between the wall of the chamber and the stationary member.

17. The system in claim 12, wherein the vane members rotate at a velocity of one-half of the rotation velocity of the hub plate.

18. The system in claim 12, wherein during a power cycle, the volumes of the spaces between the vanes increase and decrease, so that the volume of fluid injected or drawn into the chamber space between vanes is contracted or expanded.

19. The system in claim 12, wherein the inherent volume ratio of the maximum volume between vanes to the minimum volume ranges from about 2 to 1 for three vanes, or up to 8 to 1 for vanes in excess of four.

20. The system in claim 12, wherein the system operates as an engine or pump means.

21. A rotary vane mechanical power system with positive displacement characteristics, the system comprising:

a) a principal substantially closed non-circular cylindrical cavity formed by a continuous cavity wall, and a front wall and a back wall;

b) a rotating hub plate positioned within the closed cavity further closing and defining a cavity space;

c) a stationary generally ellipse-shaped stator member positioned centrally within the cavity space for further defining a travel space between the cavity wall and the wall of the stationary stator member;

d) a plurality of vanes each rotatably positioned on the rotating hub plate for extending between the cavity wall and the stator wall forming a seal therewith, to divide the cavity into individual chamber spaces between the vane means, the chamber spaces fluctuating in volume as the vanes are rotated around the cavity, and the vanes being circumferentially spaced so that adjacent vanes do not contact one another;

e) inlet means for delivering a fluid, into each chamber space at a certain point during rotation, for driving the rotation of the hub member during a power cycle;

f) exhaust means for exhausting the fluid from each chamber space during a certain point in the cycle, as the chamber space reaches its maximum volume during rotation through a power cycle;

g) a chamber limiting means substantially positioned and timed to interrupt the cavity at or near its narrowest width after one vane member has just passed, and which remains in its interrupting position until the next vane approaches, at which time it is retracted, said chamber limiting means providing increased expansion ratios, compression ratios and positive displacement characteristics of the mechanical power assembly;

h) a cam-retractor system positioned either inside the inner cavity wall or outside the outer cavity wall for providing a means for moving the chamber limiting means into a position interrupting the cavity in synchronization with the spaces between passing rotary vanes.

22. The system in claim 21, wherein the power system defines a means to extract energy from the injected fluid, such as steam, heated air and combustion gases or the like, or any fluid injected under pressure into the chambers.

23. The system in claim 21, wherein the rotating hub plate is affixed to a central shaft rotated by the hub plate and rotary vane assembly, said hub plate positioned around or near to a stationary gear.

24. The system in claim 21, wherein each of the vanes are likewise rotated by individual gears linked into the stationary gear through a reversing gear, so that reverse rotation is imparted to each of the vane gears during a power cycle.

25. The system in claim 21, wherein the vanes further comprise substantially perpendicularly positioned vane members with respect to the back plate, each member spanning and dividing the travel space between the wall of the chamber and the central stator member.

26. The system in claim 21, wherein the vanes rotate at a velocity of one-half of the rotation velocity of the hub plate.

27. The system in claim 21, wherein during a power cycle, the volumes of the spaces between the vanes increase and decrease, so that the volume of fluid injected or drawn into the chamber space between vanes is contracted or expanded.

28. The system in claim 21, wherein the inherent volume ratio of the maximum volume between vanes to the minimum volume ranges from about 2 to 1 for three vanes, or up to 8 to 1 for vanes in excess of four.

29. The system in claim 21, wherein the system operates as an engine or pump means.

30. A rotary mechanical power system, comprising:

a) a principal substantially closed cavity;

b) a rotating hub plate positioned within the closed cavity;

c) a plurality of at least three vanes, each rotatably positioned on the rotating hub plate at sufficiently circumferentially spaced apart positions so that adjacent vanes do not contact one another, for dividing the cavity into chamber spaces between the vane members, the chamber spaces fluctuating in volume as the vanes are rotated around the cavity;

d) means for delivering a fluid, into each chamber space at a certain point during rotation, for driving the rotation of the hub member during a power cycle; and e) exhausting means generally opposite said inlet means for exhausting the fluid from each chamber space, as the chamber space reaches its maximum volume during rotation through the power cycle.

31. The power system in claim 30, further comprising a stationary member positioned within the cavity space for further defining a travel space between the cavity wall and the stationary member.

* * * * *